US008372164B2

(12) United States Patent
Haan et al.

(10) Patent No.: US 8,372,164 B2
(45) Date of Patent: Feb. 12, 2013

(54) GASOLINE COMPOSITION AND PROCESS FOR THE PREPARATION OF ALKYLFURFURYL ETHER

(75) Inventors: Rene Johan Haan, Amsterdam (NL); Jean-Paul Lange, Amsterdam (NL)

(73) Assignee: Shell Oil Company, Houston, TX (US)

( * ) Notice: Subject to any disclaimer, the term of this patent is extended or adjusted under 35 U.S.C. 154(b) by 296 days.

(21) Appl. No.: 12/808,722

(22) PCT Filed: Dec. 18, 2008

(86) PCT No.: PCT/EP2008/067937

§ 371 (c)(1), (2), (4) Date: Oct. 18, 2010

(87) PCT Pub. No.: WO2009/077606

PCT Pub. Date: Jun. 25, 2009

(65) Prior Publication Data

US 2011/0035991 A1 Feb. 17, 2011

(30) Foreign Application Priority Data

Dec. 19, 2007 (EP) ..... 07123642

(51) Int. Cl.
*C10L 1/18* (2006.01)

(52) U.S. Cl. ..... 44/350

(58) Field of Classification Search ..... 44/350; 549/429, 427

See application file for complete search history.

(56) References Cited

U.S. PATENT DOCUMENTS

| | | | | |
|---|---|---|---|---|
| 3,549,340 | A | 12/1970 | Coleman | 44/63 |
| 4,236,021 | A | 11/1980 | Hsu et al. | 560/174 |
| 8,231,693 | B2 * | 7/2012 | Gruter | 44/350 |

FOREIGN PATENT DOCUMENTS

| | | |
|---|---|---|
| WO | WO8701384 | 3/1987 |
| WO | WO2007023173 | 3/2007 |

* cited by examiner

*Primary Examiner* — Cephia D Toomer

(57) ABSTRACT

A gasoline composition containing in the range of from 0.1 to 30 wt % alkylfurfuryl ether with an alkyl group having 1 to 4 carbon atoms is provided. The gasoline composition is prepared by blending the alkylfurfuryl ether in a gasoline base fuel. The alkylfurfuryl ether is prepared by reacting an alkyl alcohol having in the range of 1 to 4 carbon atoms is reacted with furfuryl alcohol by contacting a liquid phase comprising the alkyl alcohol and furfuryl alcohol with an acidic zeolite catalyst at a temperature in the range of from 50 to 200° C.

15 Claims, No Drawings

GASOLINE COMPOSITION AND PROCESS FOR THE PREPARATION OF ALKYLFURFURYL ETHER

The present application claims priority from European Patent Application 07123642.6 filed 19 Dec. 2007.

FIELD OF THE INVENTION

The invention provides a gasoline composition comprising alkylfurfuryl ether and a process for the preparation of alkylfurfuryl ether.

BACKGROUND OF THE INVENTION

Ethylfurfuryl ether, also known as 2-(ethoxymethyl)furan, is a known compound and is used as pharmaceutical and as food additive, in particular as flavour in food products. Application of ethylfurfuryl ether or other alkylfurfuryl ethers as blending component in a gasoline composition is not known.

WO 87/01384, for instance, discloses a gasoline composition comprising furfuryl alcohol. This however has the disadvantage of a low boiling point and lower stability. Yet further, U.S. Pat. No. 3,549,340 discloses a diesel fuel composition additionally comprising an adduct derivable from a series of dienes, of which one example is furfuryl methyl ether. It is known that by reacting furfuryl alcohol and an alkyl alcohol in the presence of a strong acidic catalyst, alkyllevulinate can be prepared. In U.S. Pat. No. 4,236,021, for example, is disclosed the esterification of furfuryl alcohol with a different alcohol in the presence of a strong acid catalyst such as hydrogen chloride, hydrogen bromide or oxalic acid. In WO 2007/023173 is disclosed the preparation of ethyllevulinate by reacting furfuryl alcohol and ethanol in the presence of a porous, strong acid ion-exchange resin catalyst.

SUMMARY OF THE INVENTION

It has now been found that alkylfurfuryl ether, in particular ethylfurfuryl ether, has a high octane number and is therefore a suitable compound for blending into gasoline.

Accordingly, the present invention provides a composition comprising in the range of from 0.1 to 30 wt % alkylfurfuryl ether with an alkyl group having 1 to 4 carbon atoms.

Moreover, it has been found that alkylfurfuryl ether can be prepared starting from furfuryl alcohol and an alkyl alcohol by contacting furfuryl alcohol and an alkyl alcohol with an acidic zeolite catalyst.

Accordingly, the invention further provides a process for the preparation of alkylfurfuryl ether wherein an alkyl alcohol having in the range of 1 to 4 carbon atoms is reacted with furfuryl alcohol by contacting a liquid phase comprising the alkyl alcohol and furfuryl alcohol with an acidic zeolite catalyst at a temperature in the range of from 50 to 200° C.

DETAILED DESCRIPTION OF THE INVENTION

The gasoline composition according to the invention comprises 0.1 to 30 wt % alkylfurfuryl ether. The alkylfurfuryl ether has an alkyl group with 1 to 4 carbon atoms. Preferably, the alkylfurfuryl ether is ethylfurfuryl ether. The gasoline composition preferably comprises 1 to 10 wt % alkylfurfuryl ether.

Apart from the alkylfurfuryl ether, the gasoline composition will typically further comprise a gasoline base fuel and, optionally, gasoline additives. Gasoline additives are known in the art and include, but are not limited to, anti-oxidants, corrosion inhibitors, detergents, dehazers, dyes and synthetic or mineral oil carrier fluids.

Alkylfurfuryl ether is typically prepared by reacting $C_1$-$C_4$ alkyl alcohol with furfuryl alcohol, for example using the process according to the invention. Typically, a mixture comprising alkylfurfuryl ether, unconverted $C_1$-$C_4$ alkyl alcohol and furfuryl alcohol, reaction water, and by-products such as alkyllevulinate and condensation products of furfuryl alcohol are obtained from such preparation process. The gasoline composition according to the invention may comprise $C_1$-$C_4$ alkyl alcohol, furfuryl alcohol and/or alkyllevulinate, preferably in a total concentration of up to 10 wt %. The gasoline composition may also comprise small amounts, preferably up to a few percent, of dimers of furfuryl alcohol. Thus, alkylfurfuryl ether prepared by reacting alkyl alcohol with furfuryl alcohol does not need to be separated from the reaction mixture as a purified compound before being blended in a gasoline base fuel to obtain the gasoline composition according to the invention. Preferably, reaction water, part of the alkyl alcohol and the main part of the condensation products of furfuryl alcohol are removed from the reaction mixture prior to using the mixture for blending in a gasoline base fuel.

In the process for the preparation of alkylfurfuryl ether according to the invention, an alkyl alcohol having in the range of 1 to 4 carbon atoms is reacted with furfuryl alcohol by contacting a liquid phase comprising the alkyl alcohol and furfuryl alcohol with an acidic zeolite catalyst at a temperature in the range of from 50 to 200° C., preferably of from 100 to 150° C.

If alkyl alcohol and furfuryl alcohol are reacted with each other in the presence of an acidic catalyst, mainly alkyllevulinate, alkylfurfuryl ether and oligomeric condensation products of furfuryl alcohol are formed. The formation of alkylfurfuryl ether from alkyl alcohol and furfuryl alcohol is a reversible equilibrium reaction, whereas the formation of alkyllevulinate and of oligomeric condensation products of furfuryl alcohol are irreversible reactions.

Without wishing to be bound to any theory, it is believed that mild process conditions, in particular the use of a mildly acidic catalyst such as a zeolite catalyst and mild reaction temperatures, favours the formation of alkylfurfuryl ether over the formation of alkyllevulinate.

The acidic zeolite catalyst may essentially consist of one or more acidic zeolites, i.e. without a binder. Alternatively, the zeolite catalyst may comprise zeolite and a binder, for example silica, alumina, or clay. A zeolite catalyst essentially consisting of one or more acidic zeolites is preferred. Examples of suitable zeolites are ZSM-5, ZSM-12, ZSM-23, ZSM-48, zeolite beta, mordenite, ferrierite, preferably ZSM-5.

The catalyst may be in any suitable form, for example in the form of a fixed bed of particles or in the form of dispersed particles.

The molar ratio of alkyl alcohol to furfuryl alcohol that is contacted with the catalyst is preferably in the range of from 0.5 to 20. A very low ratio, i.e. below 0.5, may result in decreased formation of alkylfurfuryl ether; a very high ratio, i.e. above 20, may result in increased formation of condensation products of furfuryl alcohol. More preferably, the molar ratio of alkyl alcohol to furfuryl alcohol is in the range of from 1 to 10. Reference herein to the molar ratio of alkyl alcohol to furfuryl alcohol that is contacted with the catalyst is, in case of batch-wise supply of alkyl alcohol and furfuryl alcohol to the catalyst, to the initial molar ratio of the liquid phase contacted with the catalyst. In case of continuous supply of alkyl alcohol and furfuryl alcohol to the catalyst, it refers to the ratio of alkyl alcohol and furfuryl alcohol in the supply stream(s).

Because the reversible formation reaction of alkylfurfuryl ether is competing with the irreversible formation reactions of alkyllevulinate and condensation products of furfuryl alcohol, the amount of alkylfurfuryl ether formed as a function of the contact time of the furfuryl alcohol with the catalyst goes through a maximum. It has been found that it mainly depends on the alkyl alcohol/furfuryl alcohol ratio of the feed mixture at which furfuryl alcohol conversion the maximum is attained. Typically, for a molar ratio of alkyl alcohol to furfuryl alcohol in the range of from 2 to 20, a maximum alkylfurfuryl ether concentration is attained at a furfuryl alcohol conversion of 90-95%. For a molar ratio of alkyl alcohol to furfuryl alcohol in the range of from 0.5 to 2, a maximum alkylfurfuryl ether concentration is attained at a much lower furfuryl alcohol conversion, typically at a furfuryl alcohol conversion in the range of from 50 to 80%.

It will be appreciated that it is preferred to control the contact time of furfuryl alcohol with the catalyst such that the reaction is not continued after the maximum in alkylfurfuryl ether concentration is attained.

If the molar ratio of alkyl alcohol to furfuryl alcohol is in the range of from 2 to 20, the contact time of furfuryl alcohol with the catalyst is preferably controlled such that the total furfuryl alcohol conversion is in the range of from 80 to 95%. If the molar ratio of alkyl alcohol to furfuryl alcohol is in the range of from 0.5 to 2, the contact time of furfuryl alcohol with the catalyst is preferably controlled such that the total furfuryl alcohol conversion is in the range of from 50 to 80%. Reference herein to total furfuryl alcohol conversion is to the total percentage of furfuryl alcohol that is converted into any product, i.e. not only to alkylfurfuryl ether but also to alkyllevulinate and condensation products of furfurylalcohol.

The reaction of the process according to the invention may be carried out batch-wise or with continuously supply of the reactants, i.e. alkyl alcohol and furfuryl alcohol. If the reactants are supplied continuously, then typically also reaction liquid is withdrawn continuously from the catalyst.

If reactants are supplied batch-wise, then the contact time is controlled by stopping the reaction, for example by cooling the liquid phase, when the desired furfuryl alcohol conversion is attained. If reactants are supplied continuously and liquid phase is withdrawn continuously, then the contact time is controlled by controlling the supply rate of furfuryl alcohol and the degree of backmixing of the liquid phase.

It will be appreciated that the optimum contact time, i.e. the contact time at which maximum alkylfurfuryl ether production is attained, mainly depends on the severity of the conditions, in particular the acidity of the catalyst and the temperature. The more acidic the catalyst and/or the higher the temperature, the sooner the maximum is attained.

The pressure at which the reactants are contacted with the catalyst is not critical. Preferably, in order to avoid evaporation of reactants, the pressure is at least the autogeneous pressure of the liquid phase at the temperature at which the reaction is carried out.

The process according to the invention may be carried out in any reactor suitable for solid/liquid contact. The flow regime may vary from plug flow to complete mixing of reactants and catalyst (continuously stirred tank reactor).

In the process according to the invention, furfuryl alcohol is preferably reacted with a 1-alkanol, more preferably with methanol or ethanol to obtain methylfurfuryl ether or ethylfurfuryl ether, even more preferably with ethanol to obtain ethylfurfuryl ether.

EXAMPLES

The composition and process according to the invention will be further illustrated by the following non-limiting examples.

Example 1

Six batches of ethylfurfuryl ether comprising liquid were prepared as follows. A feed mixture of 120 grams ethanol and 110 grams furfuryl alcohol (molar ratio ethanol/furfuryl alcohol of 2.5) was added to 10 grams acidic ZSM-5 particles with a silica-alumina ratio of 30. The mixture was contracted with the catalyst for 2.5 hours at 125° C. under stirring.

The six batches were combined and distilled in different fractions. The fraction boiling between 143 and 157° C. at atmospheric pressure (composition: 2.5 wt % EtOH; 16.6 wt % furfuryl alcohol; 77.2 wt % ethylfurfuryl ether; 3.6 wt % ethyllevulinate) was blended with 95 vol % of a gasoline base fuel having a research octane number (RON) of 94. The RON of the blend was increased with 2 RON points to 96; the motor octane number (MON) did not change in comparison with the MON of the gasoline base fuel.

Example 2

In a batch experiment, a mixture of 70 grams ethanol and 145 grams furfuryl alcohol (molar ethanol/furfuryl alcohol ratio of 1.0) was contacted with 10 grams of acidic ZSM-5 particles having a silica-alumina ratio of 30 at a temperature of 125° C. under stirring during 17 hours. The furfuryl alcohol conversion and the yield of ethylfurfuryl ether, ethyl levulinate and condensation products of furfuryl alcohol were measured as a function of the effective contact time (hours times grams catalyst per grams furfuryl alcohol).

The yield of ethylfurfuryl ether went through a maximum of 27% (mole/mole) at an effective contact time of 1.24 h*g catalyst/g furfuryl alcohol. At the maximum, the total furfuryl alcohol conversion was 67% (mole/mole), the yield of ethyl levulinate 3.4% and the yield of condensation products of furfuryl alcohol 27%. All yields are expressed as moles furfuryl alcohol converted in that product per moles furfuryl alcohol in the feed mixture.

Example 3

The batch experiment of example 2 was repeated, but now with 10 grams zeolite beta having a silica-alumina ratio of 22 as catalyst. The furfuryl alcohol conversion and the yield of ethylfurfuryl ether, ethyllevulinate and condensation products of furfuryl alcohol were measured at an effective contact time of 1.32 h*g catalyst/g furfuryl alcohol. At this contact time, 63% (mole/mole) of furfuryl alcohol was converted, the yield of ethylfurfuryl ether was 12% (mole/mole); the yield of ethyllevulinate was 0.6% (mole/mole) and the yield of condensation products of furfurylalcohol 34% (mole/mole).

We claim:

1. A gasoline composition comprising in the range of from 0.1 to 30 wt % alkylfurfuryl ether with an alkyl group having 1 to 4 carbon atoms and gasoline base fuel.

2. The gasoline composition of claim 1 wherein the alkylfurfuryl ether is ethylfurfuryl ether.

3. A process for the preparation of a gasoline composition of claim 1 comprising blending in the range of from 0.1 to 30 wt % an alkylfurfuryl ether with an alkyl group having 1 to 4 carbon atoms, with a gasoline base fuel.

4. The process of claim 3 wherein the alkylfurfuryl ether is prepared by reacting an alkyl alcohol having in the range of 1 to 4 carbon atoms with furfuryl alcohol by contacting in a liquid phase comprising the alkyl alcohol and furfuryl alcohol with an acidic zeolite catalyst at a temperature in the range of from 50 to 200° C.

5. The process of claim 4 wherein the temperature is in the range of from 100 to 150° C.

6. The process of claim 4 wherein the molar ratio of alkyl alcohol to furfuryl alcohol that is contacted with the catalyst is in the range of from 0.5 to 20.

7. The process of claim 6 wherein the molar ratio of alkyl alcohol to furfuryl alcohol that is contacted with the catalyst is in the range of from 2 to 20 and the contact time of furfuryl alcohol with the catalyst is controlled such that the total furfuryl alcohol conversion is in the range of from 80 to 95%.

8. The process of claim 6 wherein the molar ratio of alkyl alcohol to furfuryl alcohol that is contacted with the catalyst is in the range of from 0.5 to 2 and the contact time of furfuryl alcohol with the catalyst is controlled such that the total furfuryl alcohol conversion is in the range of from 50 to 80%.

9. The process of claim 4 wherein the alkyl alcohol is an 1-alkanol.

10. The gasoline composition of claim 2 further comprising one or more gasoline additives selected from the group comprising anti-oxidants, corrosion inhibitors, detergents, dehazers, dyes and synthetic or mineral oil carrier fluids.

11. The gasoline composition of claim 1 wherein the alkylfurfuryl ether is present in an amount in the range of from 1 to 10 wt %.

12. The process of claim 9 wherein the alkyl alcohol is methanol or ethanol.

13. The process of claim 12 wherein the alkyl alcohol is ethanol.

14. The process of claim 9 wherein the temperature is in the range of from 100 to 150° C.

15. The process of claim 9 wherein the molar ratio of alkyl alcohol to furfuryl alcohol that is contacted with the catalyst is in the range of from 2 to 20 and the contact time of furfuryl alcohol with the catalyst is controlled such that the total furfuryl alcohol conversion is in the range of from 80 to 95%.

* * * * *